US011859463B2

(12) United States Patent
Waghumbare et al.

(10) Patent No.: US 11,859,463 B2
(45) Date of Patent: Jan. 2, 2024

(54) PRESSURE ISOLATION RING TO ISOLATE THE SETTING CHAMBER ONCE HYDRAULIC PACKER IS SET

(71) Applicant: Halliburton Energy Services, Inc., Houston, TX (US)

(72) Inventors: Ashishkumar M. Waghumbare, Singapore (SG); Abhay Raghunath Bodake, Singapore (SG); Mukesh Bhaskar Kshirsagar, Singapore (SG); Xian Zhi Lim, Singapore (SG); Chandra Gunawan, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 36 days.

(21) Appl. No.: 17/545,105

(22) Filed: Dec. 8, 2021

(65) Prior Publication Data

US 2023/0175346 A1 Jun. 8, 2023

(51) Int. Cl.
*E21B 33/1295* (2006.01)
*E21B 23/04* (2006.01)

(52) U.S. Cl.
CPC ..... *E21B 33/1295* (2013.01); *E21B 23/0412* (2020.05); *E21B 23/0415* (2020.05); *E21B 23/0422* (2020.05); *E21B 23/04115* (2020.05)

(58) Field of Classification Search
CPC ..... E21B 33/1285; E21B 33/1295; E21B 23/0421; E21B 23/04; E21B 23/0411; E21B 23/0412
See application file for complete search history.

(56) References Cited

U.S. PATENT DOCUMENTS

| | | | |
|---|---|---|---|
| 4,941,534 | A | 7/1990 | Berzin |
| 5,044,433 | A | 9/1991 | Rubbo et al. |
| 5,375,662 | A | 12/1994 | Echols, III et al. |

(Continued)

FOREIGN PATENT DOCUMENTS

| | | |
|---|---|---|
| CA | 1284101 | 5/1991 |
| EP | 2767669 | 8/2014 |
| WO | 2008-021703 | 2/2008 |

OTHER PUBLICATIONS

International Search Report and Written Opinion for Application No. PCT/US2021/064785, dated Aug. 30, 2022.

*Primary Examiner* — Shane Bomar
(74) *Attorney, Agent, or Firm* — Scott Richardson; C. Tumey Law Group PLLC

(57) ABSTRACT

A hydraulic set packer system includes an outer sleeve and a mandrel extending through the outer sleeve. The mandrel has a setting port extending through a radial wall of the mandrel, and the setting port is configured to provide fluid communication from a central bore of the mandrel to a setting chamber formed between the outer sleeve and the mandrel. The system also includes a piston configured to move axially along the mandrel in response to a setting pressure in the setting chamber. The piston is configured to drive at least one radially actuatable component to actuate in a radial direction to engage a wellbore wall. Further, the system includes a pressure isolation assembly disposed in the setting chamber. The pressure isolation assembly is configured to move axially with respect to the mandrel from a first position to a second position to seal the setting port.

20 Claims, 10 Drawing Sheets

(56) References Cited

U.S. PATENT DOCUMENTS

| | | | | |
|---|---|---|---|---|
| 8,555,960 | B2 * | 10/2013 | Mailand | E21B 33/14 166/334.4 |
| 9,863,210 | B2 * | 1/2018 | Ezell | E21B 23/06 |
| 2009/0283279 | A1 * | 11/2009 | Patel | E21B 33/129 166/382 |
| 2014/0216764 | A1 * | 8/2014 | Derby | E21B 33/1285 166/387 |
| 2016/0230505 | A1 | 8/2016 | Garcia et al. | |
| 2019/0203559 | A1 * | 7/2019 | Ezell | E21B 33/1295 |
| 2021/0010344 | A1 * | 1/2021 | Hrupp | E21B 33/1285 |
| 2021/0270107 | A1 * | 9/2021 | Mackay | E21B 34/10 |
| 2023/0072189 | A1 * | 3/2023 | Mothilal | E21B 33/12 |
| 2023/0151715 | A1 * | 5/2023 | Kshirsagar | E21B 23/06 166/381 |
| 2023/0272685 | A1 * | 8/2023 | Dave | E21B 33/1208 166/387 |

* cited by examiner

PRESSURE ISOLATION RING TO ISOLATE THE SETTING CHAMBER ONCE HYDRAULIC PACKER IS SET

BACKGROUND

In some wellbore operations, one or more hydraulically actuated tools (e.g., hydraulic set packers) may be installed in a wellbore. Generally, hydraulic set packers include a setting chamber fluidly coupled to a central bore of the tool via a setting port. The packer may be set by providing sufficient fluid pressure (e.g., a setting pressure) through the central bore, which increases pressure in the setting chamber via the fluid communication through the setting port and actuates the packer. After setting the tool, the setting chamber may experience pressure changes based on the fluid pressure flowing through the central bore of the tool. Unfortunately, high fluid pressures present during wellbore operations may increase wear on components within the setting chamber. Further, some fluid pressures may be greater than the setting pressure, thereby requiring the components in the setting chamber to have sufficient construction (e.g., wall thickness, material properties, etc.) to reduce risk of failure during wellbore operations with these higher pressures. However, having such construction to withstand pressures higher than the setting pressure may increase cost of manufacture for these hydraulically actuated tools.

BRIEF DESCRIPTION OF THE DRAWINGS

These drawings illustrate certain aspects of some of the embodiments of the present disclosure and should not be used to limit or define the method.

DETAILED DESCRIPTION

Disclosed herein are systems for isolating a setting chamber for a hydraulically actuated tool (e.g., hydraulic set packer) after setting the hydraulically actuating tool in the wellbore. Isolating the setting chamber may allow the system to operate under higher pressure while additionally reducing wall thickness and/or other parameters for components in the setting chamber to reduce manufacturing costs for the hydraulically actuated tool.

Figure 1:
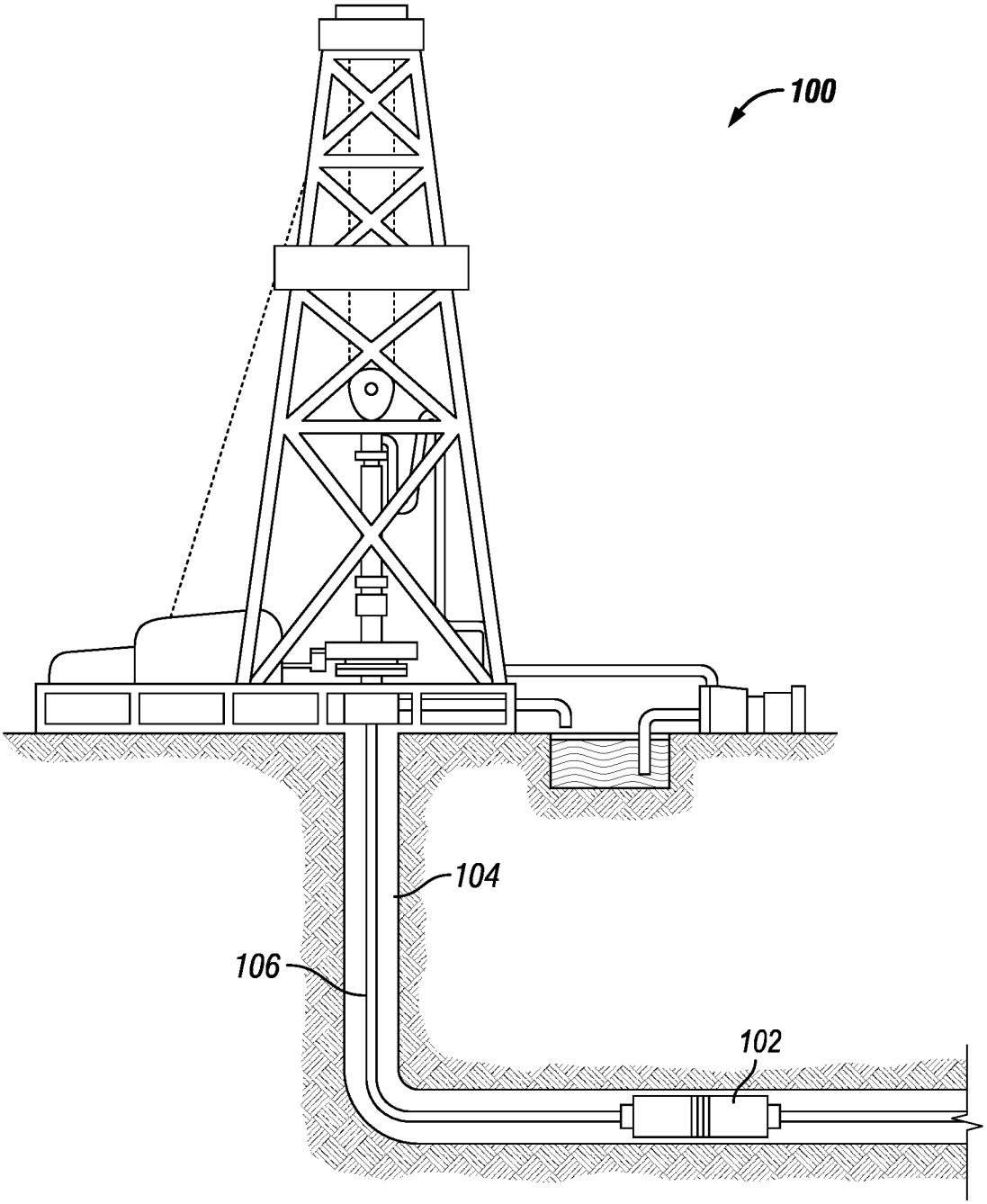
FIG. 1 illustrates a wellbore completion system having a hydraulically actuated tool disposed in a wellbore, in accordance with some embodiments of the present disclosure.

FIG. 1 illustrates a wellbore completion system 100 having a hydraulically actuated tool 102 (e.g., a hydraulic set packer system 200) disposed in a wellbore 104, in accordance with some embodiments of the present disclosure. As illustrated, the hydraulically actuated tool 102 may be run-in-hole via a conveyance 106 (e.g., coiled tubing, segmented tubing, etc.) Once the hydraulically actuated tool 102 is positioned at a desired location in the wellbore 104, fluid may be pumped through the conveyance 106 toward the hydraulically actuated tool 102. As set forth in detail below, the fluid may have sufficient pressure to set the hydraulically actuated tool 102. Moreover, continued pressure in the hydraulically actuated tool 102, after the hydraulically actuated tool 102 is set, may further actuate a pressure isolation assembly configured to seal a portion of the hydraulically actuated tool 102 from the fluid pumped through the conveyance 106.

Figure 2A:
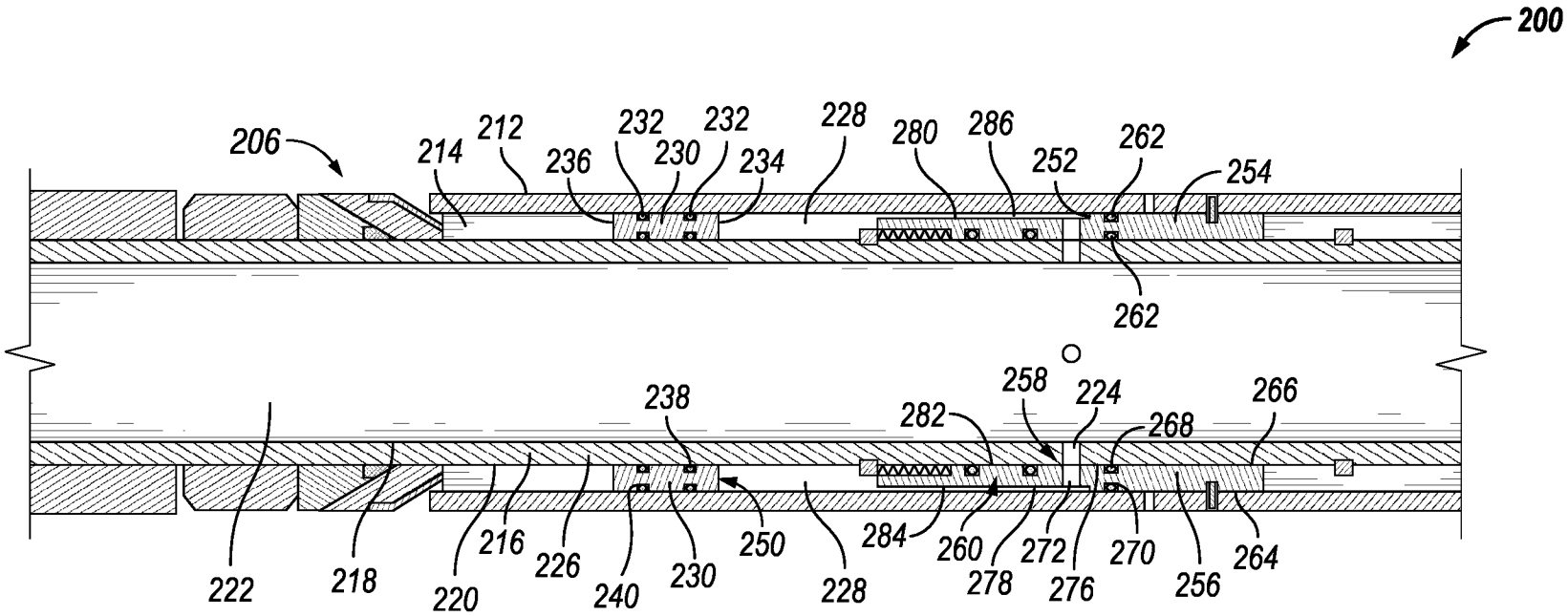
FIGS. 2A-2C illustrate cross-sectional views of a hydraulic set packer system having a pressure isolation assembly, in accordance with some embodiments of the present disclosure.
Figure 2B:
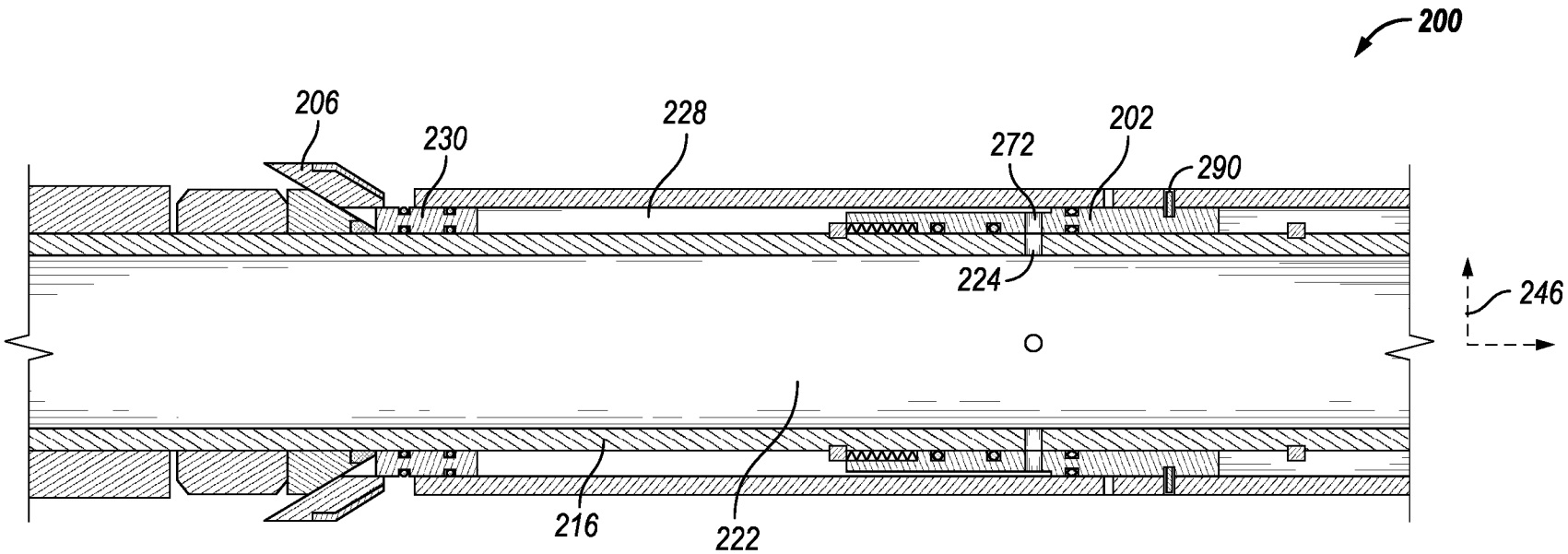
Figure 2C:
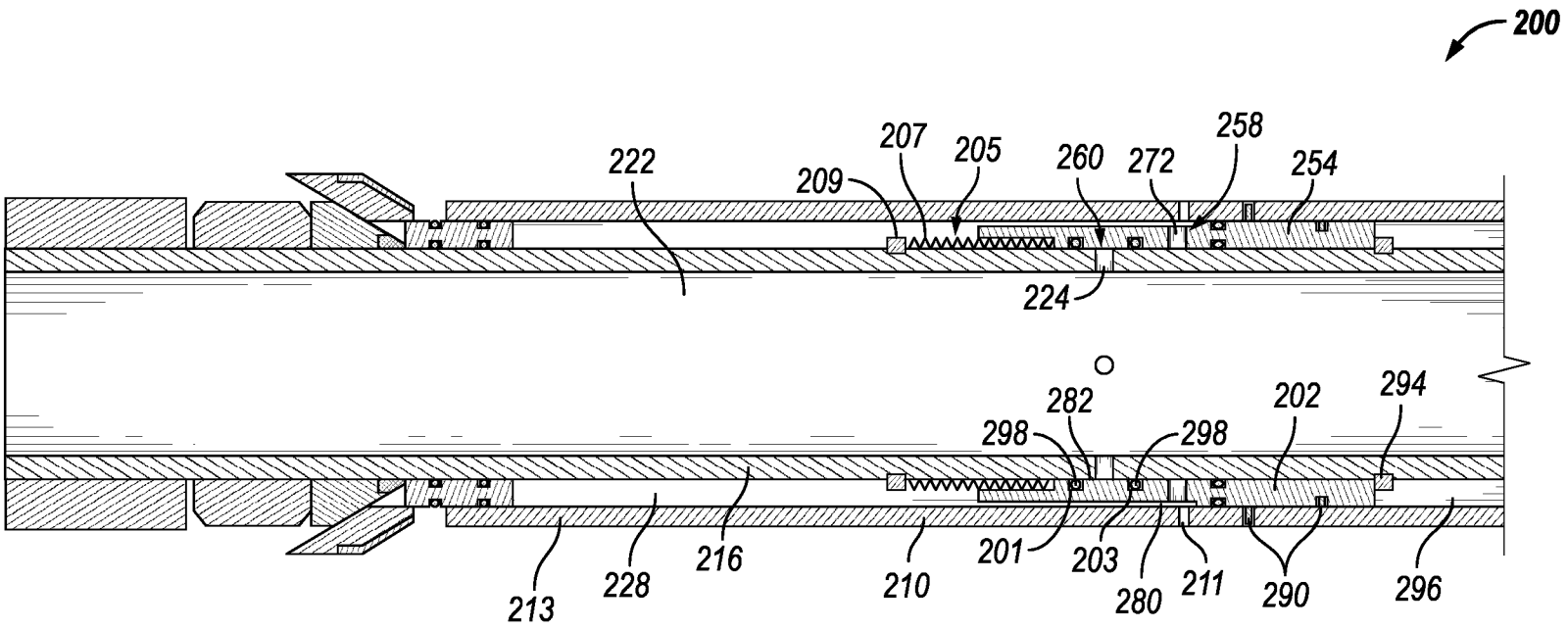

FIGS. 2A-2C illustrate cross-sectional views of a hydraulic set packer system 200 having a pressure isolation assembly 202, in accordance with some embodiments of the present disclosure. In particular, FIG. 2A illustrates an embodiment of the hydraulic set packer system 200 in a pre-set state. That is, at least one radially actuatable component 206 of the hydraulic set packer system 200 is in a collapsed position such that the hydraulic set packer system 200 may be run-in-hole. As illustrated, the hydraulic set packer system 200 includes an outer sleeve 210 having a substantially hollow cylindrical shape with a radially outer sleeve surface 212 and a radially inner sleeve surface 214. The outer sleeve 210 is positioned about a portion of a mandrel 216. That is, the mandrel 216 extends through the outer sleeve 210. The mandrel 216 also has a hollow cylindrical shape with a radially inner mandrel surface 218 and a radially outer mandrel surface 220. A central bore 222 defined by the radially inner mandrel surface 218 is configured to convey fluid from the surface through the hydraulic set packer system 200. Further, the mandrel 216 includes a setting port 224 extending through a radial wall 226 of the mandrel 216 (e.g., extending between the radially inner mandrel surface 218 and the radially outer mandrel surface 220).

The setting port 224 is configured to direct fluid from the central bore 222 to a setting chamber 228. That is, the setting port 224 may provide fluid communication between the central bore 222 and the setting chamber 228. The setting chamber 228 is formed between the outer sleeve 210 and the mandrel 216. Specifically, the setting chamber 228 is formed between the radially inner sleeve surface 214 of the outer sleeve 210 and the radially outer mandrel surface 220 of the mandrel 216. In the pre-set state of the hydraulic set packer system 200, axial ends (e.g., a first axial end 250 and a second axial end 252) of the setting chamber 228 may be sealed from the wellbore 104 via a piston 230 and a pressure isolation assembly 202.

In the illustrated embodiment, the piston 230 is disposed radially between the outer sleeve 210 and the mandrel 216. The piston 230 may include a plurality of annular piston seals 232 (e.g., O-rings) configured to form seals between the piston 230 and the radially inner sleeve surface 214, as well as between the piston 230 and the radially outer mandrel surface 220. The plurality of annular piston seals 232 may be configured to block fluid flow from an inner side 234 of the piston 230 to an outer side 236 of the piston 230 such that the piston 230 may seal the setting chamber 228 from the wellbore 104. The piston 230 may include at least one radially inner piston recess 238 and at least one radially outer piston recess 240 configured to house the plurality of annular piston seals 232. Moreover, as illustrated, the piston 230 is disposed axially between the setting port 224 and at least one radially actuatable component 206 of the hydraulic set packer system 200. The piston 230 is configured to move (e.g., slide) axially along the mandrel 216 in response to a pressure in the setting chamber 228 exceeding a threshold setting pressure (e.g., a setting pressure) to set the hydraulic set packer system 200. That is, the setting pressure is configured to drive the piston 230 from a pre-set position to a setting position in contact with the at least one radially actuatable component 206 of the hydraulic set packer system 200. Further, the setting pressure may exert a force on the piston 230 such that the piston 230 may drive at least one radially actuatable component 206 to actuate in a radially outward direction 246 to engage a wellbore 104 wall of the wellbore 104 (e.g., to drive the at least one radially actuatable component 206 from the collapsed position to an expanded position).

Moreover, pressure isolation assembly 202 may be disposed radially between the outer sleeve 210 and the mandrel 216 to seal the second axial end 252 of the setting chamber 228 opposite the piston 230. Sealing the setting chamber 228 from the wellbore 104 may reduce a pressure needed in the central bore 222 to achieve the threshold setting pressure for driving the piston 230 to set the hydraulic set packer system 200. In the illustrated embodiment, the pressure isolation assembly 202 includes a pressure isolation ring 254 having a chamber sealing portion 256, an inlet portion 258, and a port sealing portion 260. The chamber sealing portion 256 may be configured to seal the second axial end 252 of the setting chamber 228. The chamber sealing portion 256 may be positioned outside of the setting port 224. That is, the setting port 224 may be positioned axially between the piston 230 and the chamber sealing portion 256 such that fluid may enter the setting chamber 228 between the piston 230 and the chamber sealing portion 256. Moreover, the pressure isolation assembly 202 may include a plurality of isolation seals 262 configured to seal a radially outer sealing chamber surface 264 and a radially inner sealing chamber surface 266 of the chamber sealing portion 256 against the radially inner sleeve surface 214 and the radially outer mandrel surface 220. Further, the chamber sealing portion 256 may include at least one radially inner chamber sealing recess 268 and at least one radially outer chamber sealing recess 270 configured to house the plurality of isolation seals 262.

The inlet portion 258 of the pressure isolation ring 254 includes a radial through-bore 272. In the pre-set state of the hydraulic set packer system 200, the pressure isolation assembly 202 (e.g., the pressure isolation ring 254) is disposed in a first position with the radial through-bore 272 aligned with the setting port 224 such that fluid may flow into the setting chamber 228 from the central bore 222. The radial through-bore 272 may extend from a radially inner inlet surface 276 of the pressure isolation ring 254 to a radially outer inlet surface 278 of the pressure isolation ring 254. In some embodiments, the radially outer inlet surface 278 is configured to interface with the radially outer mandrel surface 220 to provide additional sealing for the setting chamber 228. However, the radially outer inlet surface 278 of the pressure isolation ring 254 is disposed radially inward from the radially inner sleeve surface 214 such that an inlet portion gap 282 is formed between the inlet portion 258 and the outer sleeve 210. As illustrated, the inlet portion gap 282 forms a portion of the setting chamber 228.

The pressure isolation ring 254 also includes the port sealing portion 260. In the first position of the pressure isolation assembly 202 (e.g., the pressure isolation ring 254) the port sealing portion 260 may be disposed between the setting port 224 and the piston 230. The port sealing portion 260 has a radially inner port sealing surface 282 and a radially outer port sealing surface 284. The radially outer port sealing surface 284 may also be disposed radially inward from the radially inner sleeve surface 214 such that a port sealing portion gap 286 is formed between the inlet portion 258 and the outer sleeve 210. The port sealing portion gap 286 may also form a portion of the setting chamber 228. In some embodiment, the radially outer port sealing surface 284 may be aligned with the radially outer inlet surface 278 such that the inlet portion gap 282 and the port sealing portion gap 286 are aligned and have a same radial width. However, in some embodiments, the radially outer port sealing surface 284 may be radially offset from the radially outer inlet surface 278.

FIG. 2B illustrates an embodiment of the hydraulic set packer system 200 in a set state. Once the hydraulic set packer system 200 is in the desired position in the wellbore 104, hydraulic pressure is pumped into the conveyance 106 to set the hydraulic set packer system 200. Specifically, as illustrated, the piston 230 is configured to move to the setting position in response to a pressure in the setting chamber 228 at or exceeding a threshold setting pressure (e.g., the setting pressure). Further, with the piston 230 in the setting position, the setting pressure may exert a force on the piston 230 such that the piston 230 may drive at least one radially actuatable component 206 to actuate in a radially outward direction 246 to engage a wellbore 104 wall of the wellbore 104 and set the hydraulic set packer system 200.

In the illustrated embodiment, the hydraulic set packer system 200 includes a shear pin 290 configured to restrain axial movement of the pressure isolation assembly 202 with respect to the mandrel 216. The shear pin 290 is configured to sustain the setting pressure such that the pressure isolation assembly 202 remains secured in the first position as the piston 230 moves from the pre-set position to the setting position. However, after the hydraulic set packer system 200 is set, pressure in the setting chamber 228 may be increased above the setting pressure due to the piston 230 being secured in the setting position (i.e., the piston 230 cannot move to expand the setting chamber 228, thereby, reducing pressure in the setting chamber 228 or holding the pressure in the setting chamber 228 at the setting pressure). Thus, continued fluid communication with the central bore 222, via the setting port 224 and the radial through-bore 272, may increase the pressure in the setting chamber 228 to a pressure in the setting chamber 228 at or exceeding a threshold sealing pressure (e.g., a sealing pressure). The shear pin 290 may be configured to shear in response to the sealing pressure.

FIG. 2C illustrates an embodiment of the hydraulic set packer system 200 in a sealed state. As set forth above, after setting the hydraulic set packer system 200, a sealing pressure in the setting chamber 228 may shear the shear pin 290 restraining axial movement of the pressure isolation assembly 202 such that the pressure isolation assembly 202 may move from the first position (shown in FIGS. 2A and 2B) to a second position and transition the hydraulic set packer system 200 to a sealed state. In particular, once the shear pin 290 is sheared, the fluid pressure in the setting chamber 228 may drive the pressure isolation assembly 202 from the first position to the second position.

In the illustrated embodiment, the hydraulic set packer system 200 includes a pressure isolation assembly stop 294 to block axial movement of the pressure isolation assembly 202 at the second position via contact with the pressure isolation assembly 202. The pressure isolation assembly stop 294 may be secured to the mandrel 216 and extend into an annulus 296 between the mandrel 216 and the outer sleeve 210. In another embodiment, the pressure isolation assembly stop 294 may be secured to the outer sleeve 210 and extend into the annulus 296 between the mandrel 216 and the outer sleeve 210. Further, in some embodiments, the pressure isolation assembly stop 294 may be secured to both the mandrel 216 and the outer sleeve 210.

Moreover, as illustrated, with the pressure isolation assembly 202 (e.g., the pressure isolation ring 254) in the second position, the port sealing portion 260 of the pressure isolation ring 254 is axially aligned with the setting port 224 to seal the setting port 224 and block fluid communication between the central bore 222 and the setting chamber 228. Indeed, in the second position, the inlet portion 258 is axially offset from the setting port 224 such that the radial through-bore 272 is misaligned with the setting port 224 and fluid may no longer enter the setting chamber 228 via the inlet portion 258. Instead, the radially inner port sealing surface 282 of the port sealing portion 260 of the pressure isolation ring 254 is axially aligned with the setting port 224. The radially inner port sealing surface 282 may have a diameter substantially similar to a diameter of the radially outer mandrel surface 220 such that the radially inner port sealing surface 282 may contact and/or seal against portions of the radially outer mandrel surface 220 adjacent the setting port 224. Further, the port sealing portion 260 may include a plurality of port seals 298 configured to seal fluid communication between the setting port 224 and the setting chamber 228. The radially inner port sealing surface 282 of the port sealing portion 260 of the pressure isolation ring 254 may include at least one first port sealing recess 201 and at least one second port sealing recess 203 configured to house the plurality of plurality of port seals 298. The at least one first port sealing recess 201 and the at least one second port sealing recess 203 may be positioned on the radially inner port sealing surface 282 such that they are disposed on opposite radial sides of the setting port 224 with the pressure isolation ring 254 in the second position.

Moreover, the hydraulic set packer system 200 may further include a biasing mechanism 205 to hold the pressure isolation assembly 202 in the second position. Once the setting chamber 228 is sealed from the central bore 222, pressure in the setting chamber 228 may reduce over time, such that pressure in the setting chamber 228 may no longer hold the pressure isolation ring 254 in the second position against the pressure isolation assembly stop 294. However, the biasing mechanism 205 may be configured to provide sufficient force against the pressure isolation ring 254 to hold the pressure isolation ring 254 in the second position. In the illustrated embodiment, the biasing mechanism 205 includes a compression spring 207 disposed between the pressure isolation assembly 202 and a spring block 209. However, the biasing mechanism 205 may include any suitable biasing mechanism 205. As illustrated, the compression spring 207 is disposed between a port sealing portion 260 of the pressure isolation assembly 202 and the spring block 209. In some embodiments, the biasing mechanism 205 is configured to help drive the pressure isolation assembly 202 from the first position in a direction toward the second position. The compression spring 207 may be compressed in the first position such that the compression spring 207 exerts a force on the pressure isolation assembly 202 in the first position. Once the shear pin 290 is sheared, the force from the compression spring 207 drives or helps drive the pressure isolation assembly 202 from the first position in a direction toward the second position.

The hydraulic set packer system 200 may further include a pressure release port 211 for the setting chamber 228. In the illustrated embodiment, the outer sleeve 210 includes the pressure release port 211. The pressure release port 211 extends through a radial sleeve wall 213 of the outer sleeve 210 to provide fluid communication between the setting chamber 228 and the wellbore 104. With the pressure isolation ring 254 in the first position, the sealing chamber portion is configured to seal the pressure release port 211 such that fluid pressure may increase to the setting pressure and the sealing pressure (shown in FIG. 2A). However, after the hydraulic set packer system 200 is set, the setting pressure and/or sealing pressure no longer needs to be maintained in the setting chamber 228. Thus, as illustrated, the hydraulic set packer system 200 may include the pressure release port 211 positioned along the outer sleeve 210 such that the pressure release port 211 may be open in the second position to release pressure to the wellbore 104. That is, in the second position, the inlet portion gap 280 formed between the inlet portion 258 and the outer sleeve 210 is aligned with the pressure release port 211 such that the setting chamber 228 is in fluid communication with the wellbore 104.

Figure 3:
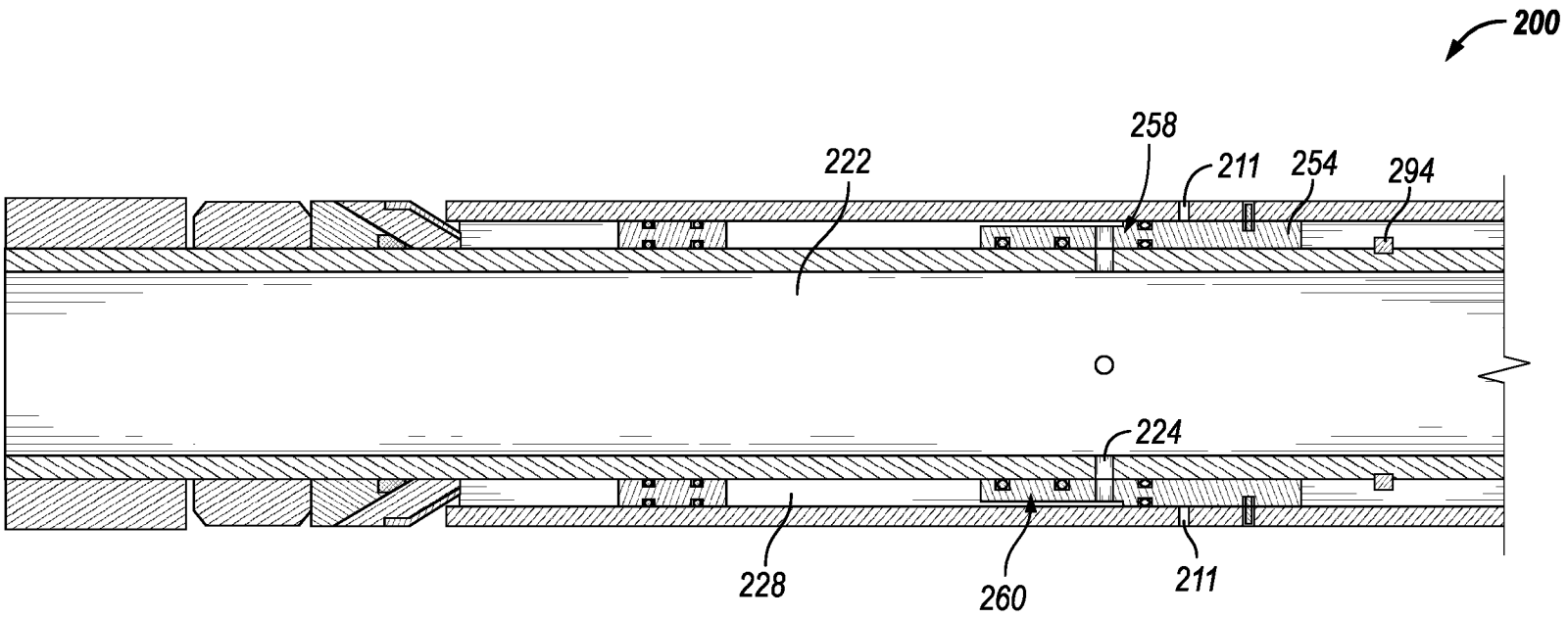
FIG. 3 illustrates a cross-sectional view the hydraulic set packer system, in accordance with some embodiments of the present disclosure.

FIG. 3 illustrates cross-sectional view of an embodiment of the hydraulic set packer system 200, in accordance with some embodiments of the present disclosure. As set forth above with respect to FIG. 2C, the hydraulic set packer system 200 may include a compression spring 207 to hold the pressure isolation ring 254 in the second position against the pressure isolation assembly stop 294. However, in the illustrated embodiment, a wellbore pressure is configured to hold pressure isolation ring 254 against the pressure isolation assembly stop 294 in the second position. As the sealing pressure in the setting chamber 228 drives the pressure isolation ring 254 to move to the second position, the port sealing portion 260 of the pressure isolation ring 254 is configured to align with the setting port 224 to seal fluid communication between the setting port 224 and the setting chamber 228. Further, in the second position, the inlet portion 258 of the pressure isolation ring 254 is configured to align with the pressure release port 211 such that the sealing pressure in the setting chamber 228 may be released into the wellbore 104. As such, a pressure (e.g., a wellbore 104 pressure) in the setting chamber 228 may equalize with a pressure in the wellbore 104 environment. As set forth above, the wellbore 104 pressure may be configured to hold the pressure isolation ring 254 in the second position such that the port sealing portion 260 of the pressure isolation ring 254 maintains the seal that isolates the setting chamber 228 from the central bore 222.

Figure 4:
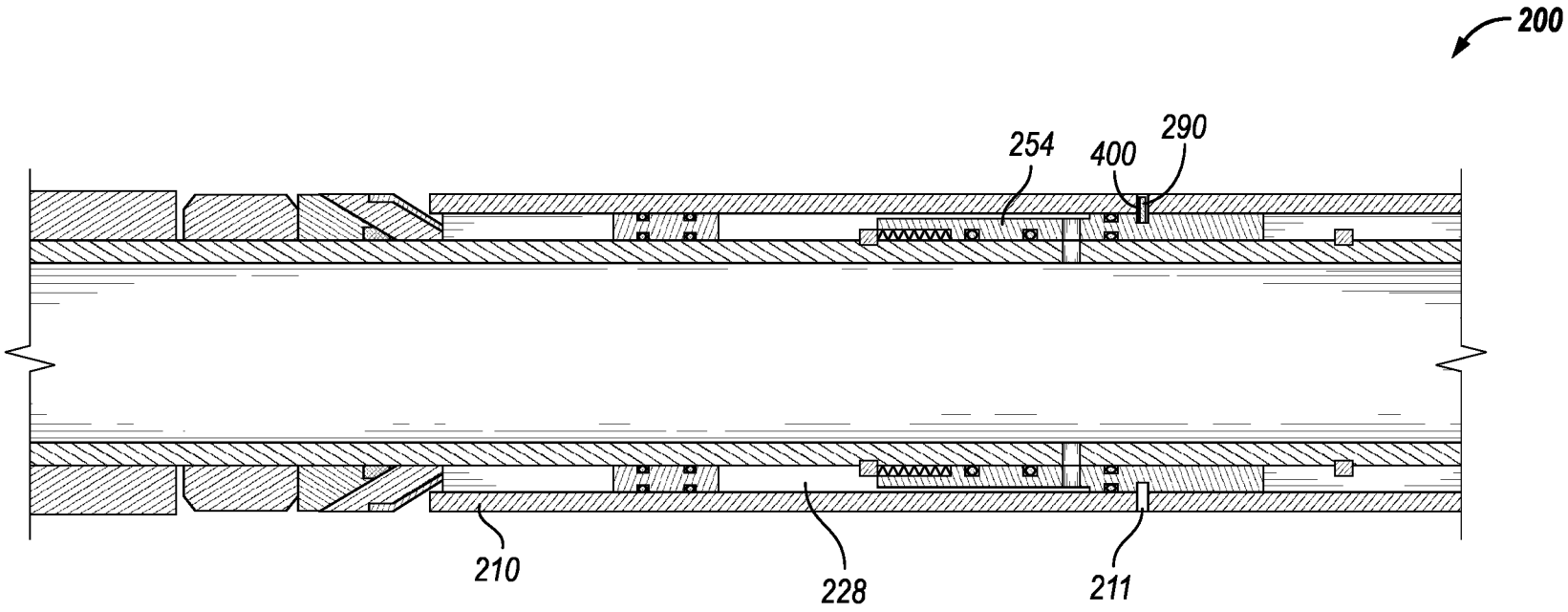
FIG. 4 illustrates a cross-sectional view of the hydraulic set packer system for retaining a sealing pressure in a setting chamber via a pressure isolation ring, in accordance with some embodiments of the present disclosure.

FIG. 4 illustrates a cross-sectional view of the hydraulic set packer system 200 for retaining a sealing pressure in a setting chamber 228 via a pressure isolation ring 254, in accordance with some embodiments of the present disclosure. As set forth above with respect to FIG. 3, the hydraulic set packer system 200 may include the pressure release port 211 positioned along the outer sleeve 210 such that the sealing pressure (e.g., for driving the pressure isolation ring 254 from the first position to the second position) may be released to the wellbore 104 in the second position. In the illustrated embodiment, the pressure release port 211 is positioned along the outer sleeve 210 at a same radial plane as at least one shear screw hole 400. After the shear pins 290 are sheared, the pressure isolation ring 254 moves to the second position, and the sealing pressure in the setting chamber 228 may be released into the wellbore 104.

Figure 5A:
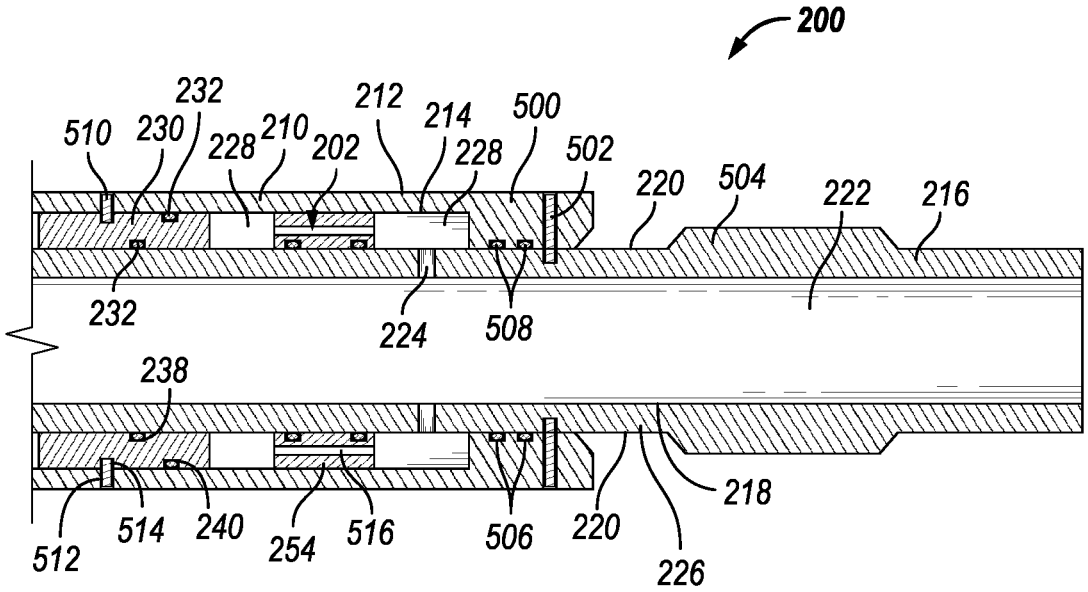
FIGS. 5A-5B illustrate cross-sectional views of the hydraulic set packer system having an isolation assembly secured to an outer sleeve, in accordance with some embodiments of the present disclosure.
Figure 5B:
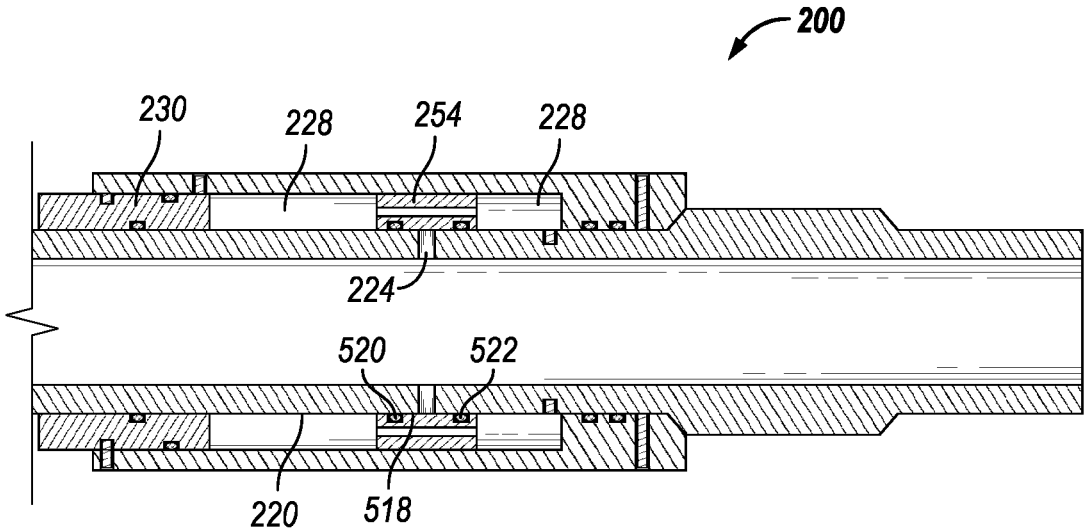

FIGS. 5A and 5B illustrate cross-sectional views of the hydraulic set packer system 200 having a pressure isolation assembly 202 secured to an outer sleeve 210, in accordance with some embodiments of the present disclosure. In particular, FIG. 5A illustrates an embodiment of the hydraulic set packer system 200 in the pre-set state. As set forth above, in the pre-set state, the at least one radially actuatable component 206 (shown in FIG. 2A-2C) of the hydraulic set packer system 200 is in the collapsed position such that the hydraulic set packer system 200 may be run-in-hole. Further, the hydraulic set packer system 200 includes the outer sleeve 210 having the substantially hollow cylindrical shape with the radially outer sleeve surface 212 and the radially inner sleeve surface 214. The outer sleeve 210 may also include a sleeve shoulder portion 500 extending radially inward from the outer sleeve 210. The sleeve shoulder portion 500 may be configured to interface with the radially outer mandrel surface 220 of the mandrel 216. Further, in the illustrated embodiment, the hydraulic set packer system 200 includes a first locking feature 502 (e.g., shear pin, set screw, etc.). The first locking feature 502 is configured to secure the outer sleeve 210 to the mandrel 216 in the pre-set state. In the illustrated embodiment, the first locking feature 502 is configured to extend radially inward from the sleeve shoulder portion 500 to secure the outer sleeve 210 to the mandrel 216. However, the first locking feature 502 may extend from any portion of the outer sleeve 210 to secure the outer sleeve 210 to the mandrel 216.

Moreover, the mandrel 216 extends through the outer sleeve 210 and has the central bore 222 for conveying fluid from the surface through the hydraulic set packer system 200. Further, the setting port 224 of the mandrel 216 extends through the radial wall 226 of the mandrel 216 (e.g., extending between the radially inner mandrel surface 218 and the radially outer mandrel surface 220). The setting port 224 is configured to provide fluid communication from the central bore 222 of the mandrel 216 to the setting chamber 228. Additionally, the mandrel 216 may include a mandrel shoulder portion 504 extending radially outward from the radially outer mandrel surface 220. The mandrel shoulder portion 504 may be configured to interface with the sleeve shoulder portion 500 during operation of the hydraulic set packer system 200.

The hydraulic set packer system 200 further includes the piston 230. In the illustrated embodiment, the setting chamber 228 is defined between the mandrel 216 and the outer sleeve 210 in the radial direction and between the piston 230 and the sleeve shoulder portion 500 in the axial direction. That is, the piston 230 and the sleeve shoulder portion 500 may each be sealed against the mandrel 216 and the outer sleeve 210 to fluidly isolate the setting chamber 228 from the wellbore 104. Further, the piston 230 and the sleeve shoulder portion 500 may include respective recesses (e.g., the radially inner piston recess 238, the radially outer piston recess 240, and sleeve shoulder recesses 506) configured to hold corresponding seals (e.g., annular piston seals 232 and sleeve shoulder seals 508) for sealing the piston 230 and the sleeve shoulder portion 500 against the mandrel 216 and the outer sleeve 210.

Moreover, in the pre-set state, the piston 230 may be secured to the outer sleeve 210 via a second locking feature 510 (e.g., shear pin, set screw, etc.). For example, the second locking feature 510 may include a shear pin extending into a sleeve locking recess 512 of the outer sleeve 210 and a piston locking recess 514 in the piston 230 to restrain axial movement between the piston 230 and the outer sleeve 210. The second locking feature 510 is configured to release the piston 230 to move axially with respect to the outer sleeve 210 in response to the setting pressure (e.g., a pressure at or above the threshold setting pressure) in the setting chamber 228. In some embodiments, the second locking feature 510 may be configured to shear to release the piston 230. The released piston 230 is configured to set the hydraulic set packer system 200. That is, with the piston 230 released, the setting pressure is configured to drive the piston 230 from a pre-set position to a setting position in contact with the at least one radially actuatable component 206 (shown in FIGS. 2A-2C) of the hydraulic set packer system 200. Further, the setting pressure may exert a force on the piston 230 such that the piston 230 may drive at least one radially actuatable component 206 to actuate in a radially outward direction 246 to engage a wellbore 104 wall of the wellbore 104 (e.g., to drive the at least one radially actuatable component 206 from the collapsed position to an expanded position).

Moreover, as set forth above, the hydraulic set packer system 200 includes the first locking feature 502 (e.g., shear pin) configured to secure the outer sleeve 210 to the mandrel 216 in the pre-set state. The first locking feature 502 is configured to sustain the setting pressure such that the outer sleeve 210 remains secured to the mandrel 216 as the piston 230 moves from the pre-set position to the setting position. However, after the hydraulic set packer system 200 is set, pressure in the setting chamber 228 may be increased above the setting pressure due to the piston 230 being secured in the setting position (i.e., the piston 230 cannot move to expand the setting chamber 228, thereby, reducing pressure in the setting chamber 228 or holding the pressure in the setting chamber 228 at the setting pressure). Thus, continued fluid communication with the central bore 222, via the setting port 224, may increase the pressure in the setting chamber 228 to a pressure in the setting chamber 228 at or exceeding a threshold sealing pressure (e.g., the sealing pressure). The first locking feature 502 may be configured to release (e.g., shear) in response to the sealing pressure such that the outer sleeve 210 may move axially with respect to the mandrel 216.

The hydraulic set packer system 200 further includes the pressure isolation ring 254. In the illustrated embodiment, the pressure isolation ring 254 is rigidly coupled to the radially inner sleeve surface 214 of the outer sleeve 210 and disposed within the setting chamber 228. In some embodiments, the pressure isolation ring 254 may be threaded to the outer sleeve 210. However, in other embodiments, the pressure isolation ring 254 may be rigidly coupled to the outer sleeve 210 via any suitable fastener. Moreover, as the pressure isolation ring 254 is rigidly coupled to the outer sleeve 210, the pressure isolation ring 254 may be configured to move axially with respect to the mandrel 216 as the outer sleeve 210 moves. In the illustrated embodiment, with the outer sleeve 210 secured to the mandrel 216 via the first locking feature 502, the pressure isolation ring 254 is disposed in the first position. In the first position, the pressure isolation ring 254 is disposed between the setting port 224 and the piston 230. The pressure isolation ring 254 may include an axial through-bore 516 such that piston 230 is in fluid communication with the setting port 224 in the first position. However, as set forth in detail below, the pressure isolation ring 254 is configured to move from the first position to the second position after the piston 230 moves to the set position. The mandrel shoulder portion 504 may be positioned to interface with the sleeve shoulder portion 500 to stop axial movement of the outer sleeve 210 with the pressure isolation ring 254 disposed in the second position.

FIG. 5B illustrates an embodiment of the hydraulic set packer system 200 in the sealed state. In the sealed state, the piston 230, having set the hydraulic set packer system 200, is disposed in the setting position. Further, the pressure isolation ring 254 is disposed in the second position. In the second position, the pressure isolation ring 254 is axially aligned with the setting port 224 such that the pressure isolation ring 254 may block fluid communication between the setting port 224 and the setting chamber 228. A radially inner ring surface 518 of the pressure isolation ring 254 may have a diameter substantially similar to a diameter of the radially outer mandrel surface 220 such that the radially inner surface of the pressure isolation ring 254 may contact and/or seal against portions of the radially outer mandrel surface 220 adjacent the setting port 224. Further, the pressure isolation ring 254 may include a first isolation seal 520 and a second isolation seal 522 disposed on opposite axial sides of the setting port 224 to seal the setting chamber 228 from the setting port 224 and block fluid communication between the setting port 224 and the setting chamber 228.

Figure 6A:
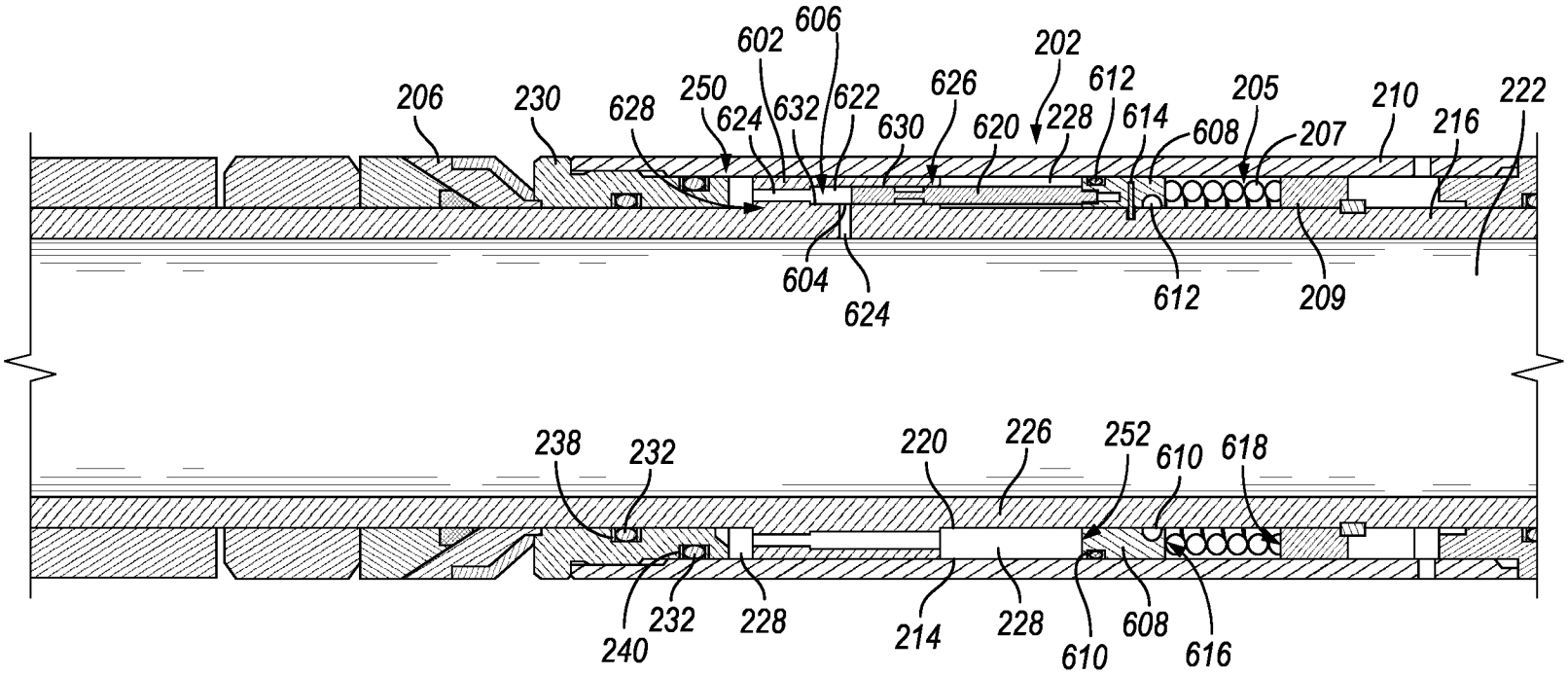
FIGS. 6A-6C illustrate cross-sectional views of the hydraulic set packer system having a pressure isolation assembly with an isolation piston, in accordance with some embodiments of the present disclosure.
Figure 6B:
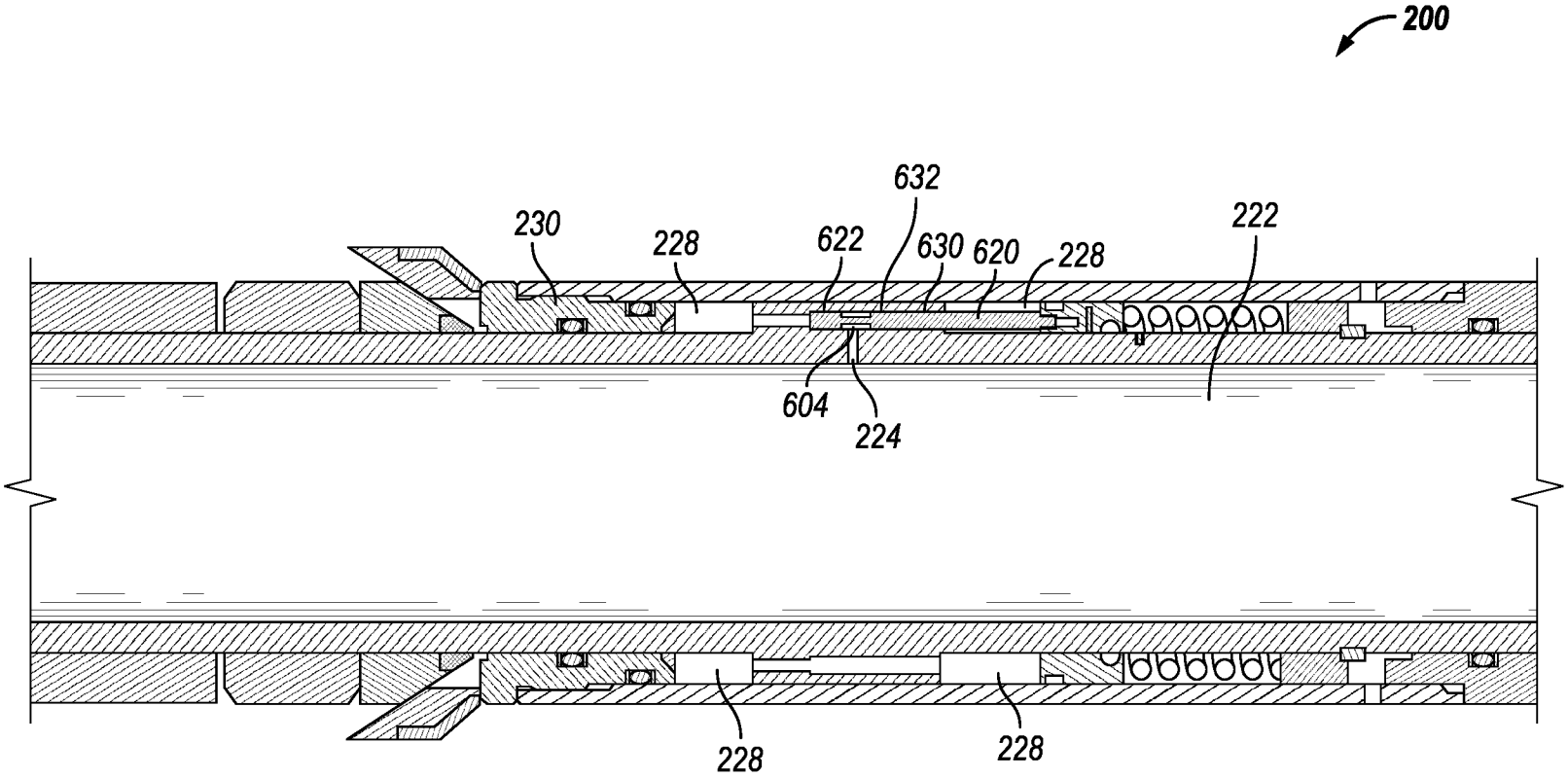
Figure 6C:
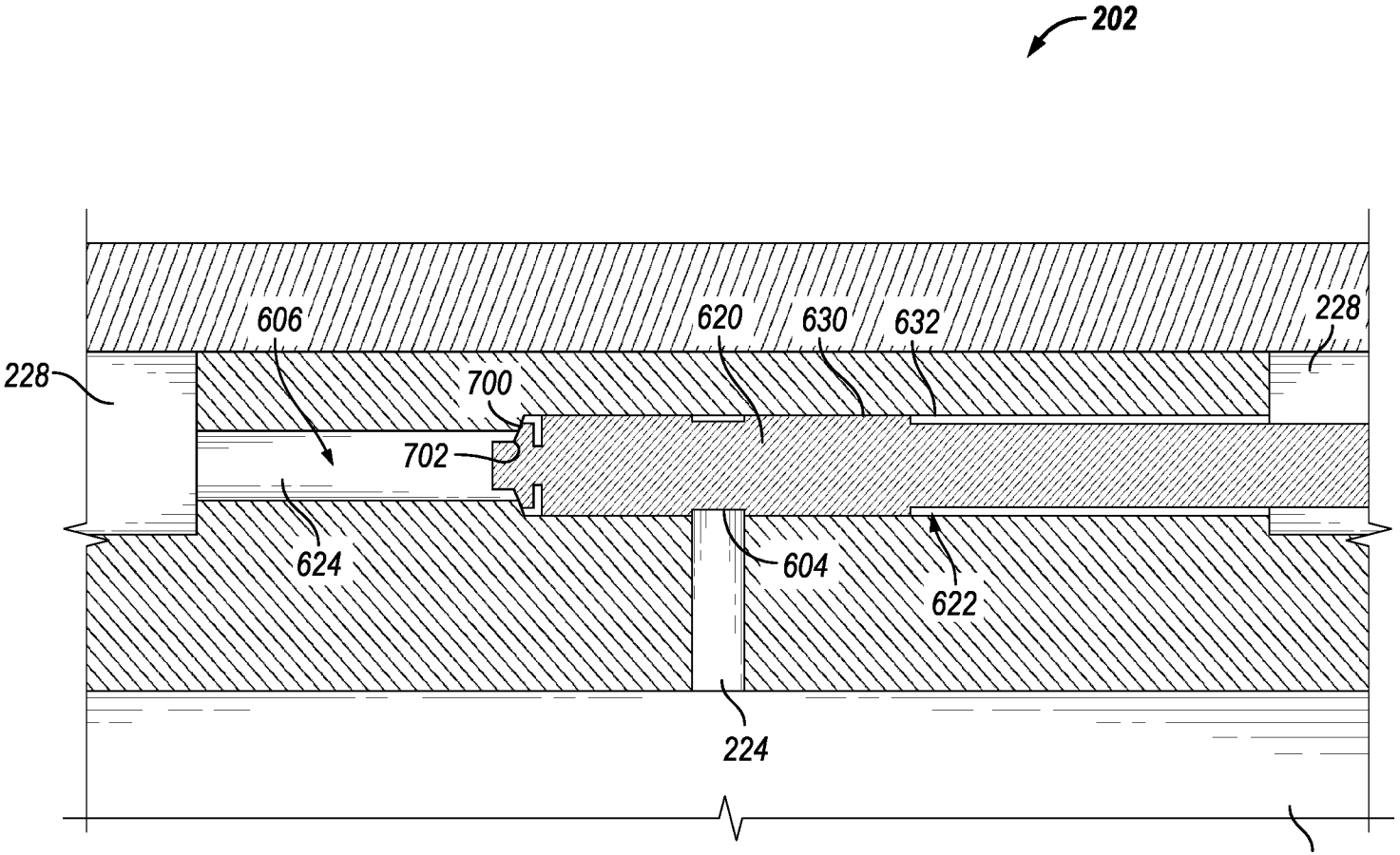

FIGS. 6A-6C illustrate cross-sectional views of the hydraulic set packer system 200 having the pressure isolation assembly 202 with an isolation piston 620, in accordance with some embodiments of the present disclosure. Specifically, FIG. 6A illustrates an embodiment of the hydraulic set packer system 200 in the pre-set state. As set forth above, the hydraulic set packer system 200 includes the outer sleeve 210 with the mandrel 216 extending through the outer sleeve 210. The mandrel 216 has the central bore 222 for conveying fluid from the surface through the hydraulic set packer system 200. As set forth above, the mandrel 216 includes the setting port 224 extending through the radial wall 226 of the mandrel 216. In the illustrated embodiment, the mandrel 216 further includes a piston seal assembly 602 in fluid communication with the setting port 224. The piston seal assembly 602 may be formed via a protrusion extending radially outward from the radially outer mandrel surface 220 of the mandrel 216. That is, the piston seal assembly 602 may be a feature of the mandrel 216. However, in some embodiments, the piston seal assembly 602 may be coupled to the mandrel 216 via a fastener. Moreover, as illustrated, an intake opening 604 of the piston seal assembly 602 is axially aligned with the setting port 224 such that the piston seal assembly 602 may be in fluid communication with the central bore 222 via the setting port 224. The piston seal assembly 602 may receive the fluid communication via the intake opening 604 into a stepped through bore 606 extending through the piston seal assembly 602. The stepped through-bore 606 may include at least two portions having distinct diameters along a length of the stepped through-bore 606 such that a shoulder 700 (shown in FIG. 7) is formed at each step/transition between adjacent portions. The stepped through-bore 606 is fluidly coupled with the setting chamber 228, such that fluid communication between the setting chamber 228 and the central bore 222 is established through the setting chamber 228, the intake opening 604, and the stepped through-bore 606.

Moreover, the hydraulic set packer system 200 further includes the piston 230. In the pre-set state, the piston 230 may be disposed in the pre-set position with at least a portion of the piston 230 disposed between the mandrel 216 and the outer sleeve 210. In some embodiments, the piston 230 may define a first axial end 250 of the setting chamber 228. As illustrated, the piston 230 may each be sealed against the mandrel 216 and the outer sleeve 210 to fluidly isolate the first axial end 250 of the setting chamber 228 from the wellbore 104. Further, the piston 230 may include a plurality of recesses (e.g., the radially inner piston recess 238 and the radially outer piston recess 240) configured to hold corresponding annular piston seals 232 for sealing the piston 230 against the mandrel 216 and the outer sleeve 210.

A second axial end 252 of the setting chamber 228 may be defined by a guide feature 608 of the hydraulic set packer system 200. As illustrated, the guide feature 608 may comprise an annular ring disposed between the mandrel 216 and the outer sleeve 210 on an opposite side of the piston seal assembly 602. The guide feature 608 may be secured to the mandrel 216, the outer sleeve 210, or some combination thereof, such that the guide feature 608 remains secured as the piston 230 sets the hydraulic set packer system 200. Further, the guide feature 608 may each be sealed against the mandrel 216 and the outer sleeve 210 to fluidly isolate the second axial end 252 of the setting chamber 228 from the wellbore 104. Further, the guide feature 608 may include a plurality of guide recesses 610 configured to hold corresponding guide seals 612 for sealing the guide feature 608 against the mandrel 216 and the outer sleeve 210. Moreover, a portion of the radially inner sleeve surface 214 of the outer sleeve 210 and a portion of the radially outer mandrel surface 220 of the mandrel 216 may define respective radial ends of the setting chamber 228.

Pressure in the setting chamber 228 is configured to set and seal the hydraulic set packer system 200. Indeed, the piston 230 is configured to move axially with respect to the outer sleeve 210 to set the hydraulic set packer system 200 in response to the setting pressure (e.g., a pressure at or above the threshold setting pressure) in the setting chamber 228. That is, the setting pressure is configured to drive the piston 230 from a pre-set position to the setting position in contact with the at least one radially actuatable component 206 of the hydraulic set packer system 200. Further, the setting pressure may exert a force on the piston 230 such that the piston 230 may drive at least one radially actuatable component 206 to actuate in a radially outward direction 246 to engage a wellbore wall of the wellbore 104 (e.g., to drive the at least one radially actuatable component 206 from the collapsed position to an expanded position).

Moreover, as set forth above, the hydraulic set packer system 200 includes the guide feature 608. In a secured state (i.e., secured to the mandrel 216, the outer sleeve 210, or some combination thereof), the guide feature 608 blocks movement of an isolation piston 620 and/or biasing mechanism 205. The guide feature 608 may be secured via at least one fastener 614 (e.g., shear pin) configured to sustain the setting pressure such that the guide feature 608 remains secured to the mandrel 216 as the piston 230 moves from the pre-set position to the setting position. However, after the hydraulic set packer system 200 is set, pressure in the setting chamber 228 may be increased above the setting pressure due to the piston 230 being secured in the setting position (i.e., the piston 230 cannot move to expand the setting chamber 228, thereby, reducing pressure in the setting chamber 228 or holding the pressure in the setting chamber 228 at the setting pressure). Thus, continued fluid communication with the central bore 222, via the setting port 224, the intake opening 604, and the stepped through-bore 606, may increase the pressure in the setting chamber 228 to a pressure in the setting chamber 228 at or exceeding a threshold sealing pressure (e.g., the sealing pressure). The fastener 614 may be configured to shear in response to the sealing pressure to release the guide feature 608 such that the guide feature 608 may move axially with respect to the mandrel 216.

In a released state, the guide feature 608 also releases the biasing mechanism 205. The biasing mechanism 205 is configured to drive the isolation piston 620 from the first position to the second position. In the illustrated embodiment, the guide feature 608 is disposed between the biasing mechanism 205 and the isolation piston 620. Further, the isolation piston 620 may be coupled to the guide feature 608 such that the isolation piston 620 may move axially with the guide feature 608. Thus, the biasing mechanism 205 may be configured to drive the guide feature 608 axially along the mandrel 216 to drive the isolation piston 620 from the first position to the second position. The biasing mechanism 205 may include the compression spring 207 having a first spring end 616 coupled to the guide feature 608 and a second spring end 618 coupled to the spring block 209. The compression spring 207 may be compressed with the isolation piston 620 in the first position. That is, the compression spring 207 may be compressed with the guide feature 608 in the secured state such the compression spring 207 expand to drive the guide feature 608 and isolation piston 620 when the guide feature 608 is released. In some embodiments, the biasing mechanism 205 may be coupled directly to the isolation piston 620.

The isolation piston 620 is configured to move axially with respect to the mandrel 216 from the first position to the second position to seal the setting port 224. However, in the first position, the isolation piston 620 is axially offset from the setting port 224. In the illustrated embodiment, the isolation piston 620 is disposed partially within the stepped through-bore 606 of the piston seal assembly 602. The stepped through-bore 606 includes a wide bore portion 622 and a narrow bore portion 624, with the wide bore portion 622 having a larger inner diameter than the narrow bore portion 624. The wide bore portion 622 and the narrow bore portion 624 may be substantially coaxial. Further, the wide bore portion 622 extends axially across a portion of the piston seal assembly 602 from a biasing side 626 of the piston seal assembly 602. The narrow bore extends from a piston side 628 of the piston seal assembly 602 to the wide bore portion 622 such that the narrow bore portion 624 is in fluid communication with the wide bore portion 622. The intake opening 604 may be in fluid communication with the wide bore portion 622. Moreover, in the first position, the isolation piston 620 is disposed in the wide bore portion 622 of the stepped through-bore 606. An outer isolation piston surface 630 of the isolation piston 620 may have a substantially similar diameter to an inner wide bore surface 632 of the wide bore portion 622 such that the isolation piston 620 may radially seal against the inner wide bore surface 632. Indeed, the isolation piston 620 may block fluid from flowing out of the biasing side 626 of the piston seal assembly 602 via the wide bore portion 622 such that the fluid flow through the intake opening 604 may pass into the wide bore portion 622 and flow through the narrow bore portion 624 toward the setting chamber 228.

FIG. 6B illustrates an embodiment of the hydraulic set packer system 200 in the sealed state. In the sealed state, the piston 230, having set the hydraulic set packer system 200, is disposed in the setting position. Further, the isolation piston 620 is disposed in the second position. In the second position, the isolation piston 620 is axially aligned with the intake opening 604 in the wide bore portion 622 and the setting port 224 such that the isolation piston 620 may block fluid communication between the central bore 222 and the setting chamber 228. As set forth above, the outer isolation piston surface 630 of the isolation piston 620 may seal against portions of the inner wide bore surface 632 adjacent the intake opening 604 and the setting port 224 via vee packing. Alternatively, the isolation piston may house a sealing system (e.g., O-rings) having a diameter substantially similar to the inner wide bore surface 632 of the wide bore portion 622 to seal against portions of the inner wide bore surface 632 adjacent the intake opening 604 and the setting port 224. As such, the isolation piston 620 may block fluid communication between the central bore 222 and the setting chamber 228.

FIG. 6C illustrates cross-sectional view of the isolation assembly 202 having the isolation piston 620. In the illustrated embodiment, the isolation piston 620 is disposed in the second position. As set forth above, in the second position, the isolation piston 620 is axially aligned with the intake opening 604 in the wide bore portion 622 and the setting port 224 such that the isolation piston 620 may block fluid communication between the central bore 222 and the setting chamber 228. Specifically, the outer isolation piston surface 630 of the isolation piston 620 may contact and/or seal against portions of the inner wide bore surface 632 of the wide bore portion 622 adjacent the intake opening 604 and the setting port 224 to form a seal around the intake opening 604 such that the isolation piston 620 may block fluid communication between the central bore 222 and the setting chamber 228.

Further, as illustrated, the isolation piston 620 may be configured to seal the wide bore portion 622 from the narrow bore portion 624 of the stepped through-bore 606. In particular, a shoulder 700 of the stepped through-bore 606 may be formed at the transition from the wide bore portion 622 to the narrow bore portion 624 due to the wide bore portion 622 and the narrow bore portion 624 having different inner diameters. In the second position, an axial sealing face 700 of the isolation piston 620 is configured to contact the shoulder 700 with the isolation piston 620 in the second position. The axial sealing face 702 of the isolation piston 620 is configured to seal against the shoulder 700 of the stepped through-bore 606, via the contact, to form an additional seal between the central bore 222 and the setting chamber 228. In some embodiment, the piston seal assembly 602 and the isolation piston 620 may include metal material such that driving the axial sealing face 702 against the shoulder 700 forms metal to metal sealing.

Accordingly, the present disclosure may provide systems for isolating a setting chamber of a hydraulically actuated tool and may include any of the various features disclosed herein, including one or more of the following statements.

Statement 1. A hydraulic set packer system may comprise an outer sleeve; a mandrel extending through the outer sleeve; a setting port extending through a radial wall of the mandrel, the setting port configured to provide fluid communication from a central bore of the mandrel to a setting chamber formed between the outer sleeve and the mandrel; a piston configured to move axially along the mandrel in response to a setting pressure in the setting chamber, the piston configured to drive at least one radially actuatable component to actuate in a radial direction to engage a wellbore wall; and a pressure isolation assembly disposed in the setting chamber, the pressure isolation assembly configured to move axially with respect to the mandrel from a first position to a second position to seal the setting port.

Statement 2. The system of statement 1, wherein the pressure isolation assembly comprises a pressure isolation ring having a radial through-bore, wherein the radial through-bore is axially aligned with the setting port in the first position such that fluid may flow into the setting chamber from the central bore.

Statement 3. The system of statement 1 or statement 2, further comprising a shear pin configured to restrain axial movement of the pressure isolation assembly with respect to the mandrel, and wherein the shear pin is configured to shear in response to pressure in the setting chamber exceeding a threshold setting pressure.

Statement 4. The system of any preceding statement, further comprising a biasing mechanism configured to drive the pressure isolation assembly from the first position in a direction toward the second position.

Statement 5. The system of any preceding statement, wherein the biasing mechanism comprises a compression spring disposed between the pressure isolation assembly and a spring block, and wherein the compression spring is compressed in the first position.

Statement 6. The system of any preceding statement, wherein the outer sleeve comprises a pressure release port extending through a radial wall of the outer sleeve, wherein the pressure release port is configured to provide fluid communication between the setting chamber and a wellbore.

Statement 7. The system of any preceding statement, wherein the pressure isolation assembly is configured to seal the pressure release port in the first position and open the pressure release port in the second position.

Statement 8. The system of any preceding statement, further comprising a pressure isolation assembly stop secured to the mandrel, wherein pressure isolation assembly stop is configured contact the pressure isolation assembly to block axial movement of the pressure isolation assembly at the second position.

Statement 9. The system of any preceding statement, wherein the piston is a least partially disposed within the setting chamber to seal a first side of the setting chamber from the wellbore.

Statement 10. The system of statement 1 or statements 3-9, wherein the pressure isolation assembly comprises a pressure isolation ring having an axial through-bore.

Statement 11. The system of statement 1 or statements 3-9, wherein the pressure isolation assembly comprises an isolation piston, wherein isolation piston configured to move axially into a piston seal assembly aligned with the setting port to seal the setting port.

Statement 12. A hydraulic set packer system may comprise an outer sleeve; a mandrel extending through the outer sleeve and secured to the outer sleeve via a first locking feature; a setting port extending through a radial wall of the mandrel, the setting port configured to provide fluid communication from a central bore of the mandrel to a setting chamber formed between the outer sleeve and the mandrel; a piston secured to the outer sleeve via a second locking feature that is configured to release the piston to move axially with respect to the outer sleeve in response to a setting pressure in the setting chamber, the piston configured to drive at least one radially actuatable component to actuate in a radial direction to engage a wellbore wall; and a pressure isolation ring rigidly coupled to a radially inner surface of the outer sleeve and disposed within the setting chamber, the pressure isolation ring configured to move axially with respect to the mandrel from a first position to a second position to seal the setting port.

Statement 13. The system of statement 12, wherein the pressure isolation ring is disposed between the setting port and the piston in the first position, and wherein the pressure isolation ring comprises an axial through-bore such that piston is in fluid communication with the setting port in the first position.

Statement 14. The system of statement 12 or statement 13, wherein the pressure isolation ring is axially aligned with the setting port in the second position, and wherein the pressure isolation ring comprises a first seal and a second seal disposed on opposite axial sides of the setting port to seal the setting chamber from the setting port.

Statement 15. The system of any of statements 12-14, wherein the second locking feature comprises a shear pin extending into a first sleeve recess of the outer sleeve and a piston recess in the piston to restrain axial movement between the piston and the outer sleeve, wherein the second locking feature is configured to shear to release the piston to move axially with respect to the outer sleeve in response to the setting pressure in the setting chamber.

Statement 16. The system of any of statements 12-15, wherein the first locking feature comprises a shear pin extending into a sleeve recess of the outer sleeve and a mandrel recess in the mandrel to restrain axial movement between the mandrel to the outer sleeve, wherein the first locking feature is configured to shear to release the outer sleeve with respect to the mandrel in response to a sealing pressure in the setting chamber, and wherein the sealing pressure is higher than the setting pressure.

Statement 17. A hydraulic set packer system, comprising: an outer sleeve; a mandrel extending through the outer sleeve; a setting port extending through a radial wall of the mandrel, the setting port configured to provide fluid communication from a central bore of the mandrel to a setting chamber formed between the outer sleeve and the mandrel, and wherein the mandrel includes a piston seal assembly to receive the fluid communication via the setting port into a stepped through-bore extending axially through the piston seal assembly and direct the fluid communication into the setting chamber; a piston configured to move axially along the mandrel in response to a setting pressure in the setting chamber, wherein the piston is configured to drive at least one radially actuatable component to actuate in a radial direction to engage a wellbore wall; and an isolation piston disposed in the setting chamber, wherein the isolation piston is configured to move axially with respect to the mandrel from a first position to a second position to seal the setting port, wherein the isolation piston is at least partially disposed in the stepped through-bore in the second position, and wherein a radially outer surface of the isolation piston is configured to seal the setting bore from the stepped through-bore; a biasing mechanism configured to drive the isolation piston from the first position to the second position; and a guide feature configured to block movement of the biasing mechanism in a secured state and release the biasing mechanism to drive the isolation piston in the released state, wherein the guide feature is configured to transition from the secured state to the released state in response to a sealing pressure in the setting chamber, wherein the sealing pressure is higher than the setting pressure.

Statement 18. The system of statement 17, wherein an axial sealing face of the isolation piston is configured to seal against a shoulder of the stepped through-bore to form an additional seal between the setting port and the setting chamber, the shoulder formed between a narrow portion of the stepped through-bore having a first diameter and a wide portion of the stepped through-bore having a second diameter.

Statement 19. The system of statement 17 or statement 18, wherein the biasing mechanism comprises a compression spring, and wherein the compression spring is compressed in the first position.

Statement 20. The system of any of statements 17-19, wherein the guide feature comprises at least one shear pin configured to hold the guide feature in the secured state, and wherein the setting pressure in the setting chamber is configured to shear the at least one shear pin to transition the guide feature from the secured state to the released state.

To facilitate a better understanding of the present invention, the following examples of certain aspects of some embodiments are given. In no way should the following examples be read to limit, or define, the entire scope of the disclosure.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A hydraulic set packer system, comprising:

an outer sleeve;

a mandrel extending through the outer sleeve;

a setting port extending through a radial wall of the mandrel, the setting port configured to provide fluid communication from a central bore of the mandrel to a setting chamber formed between the outer sleeve and the mandrel;

a piston configured to move axially along the mandrel in response to a setting pressure in the setting chamber, the piston configured to drive at least one radially actuatable component to actuate in a radial direction to engage a wellbore wall;

a pressure isolation assembly disposed in the setting chamber, the pressure isolation assembly configured to move axially with respect to the mandrel from a first position to a second position to seal the setting port; and a shear member configured to restrain axial movement of the pressure isolation assembly with respect to the mandrel, and wherein the shear member is configured to shear in response to pressure in the setting chamber exceeding a threshold setting pressure.

2. A hydraulic set packer system, comprising:

an outer sleeve;

a mandrel extending through the outer sleeve;

a setting port extending through a radial wall of the mandrel, the setting port configured to provide fluid communication from a central bore of the mandrel to a setting chamber formed between the outer sleeve and the mandrel;

a piston configured to move axially along the mandrel in response to a setting pressure in the setting chamber, the piston configured to drive at least one radially actuatable component to actuate in a radial direction to engage a wellbore wall; and a pressure isolation assembly disposed in the setting chamber, the pressure isolation assembly configured to move axially with respect to the mandrel from a first position to a second position to seal the setting port, wherein the pressure isolation assembly comprises a pressure isolation ring having a radial through-bore such that fluid may flow into the setting chamber from the central bore in the first position.

3. The system of claim 1, further comprising a biasing mechanism configured to drive the pressure isolation assembly from the first position in a direction toward the second position.

4. The system of claim 3, wherein the biasing mechanism comprises a compression spring disposed between the pressure isolation assembly and a spring block, and wherein the compression spring is compressed in the first position.

5. The system of claim 1, wherein the outer sleeve comprises a pressure release port extending through a radial wall of the outer sleeve, wherein the pressure release port is configured to provide fluid communication between the setting chamber and a wellbore.

6. A hydraulic set packer system, comprising:

an outer sleeve, wherein the outer sleeve comprises a pressure release port extending through a radial wall of the outer sleeve, wherein the pressure release port is configured to provide fluid communication between a setting chamber and a wellbore;

a mandrel extending through the outer sleeve;

a setting port extending through a radial wall of the mandrel, the setting port configured to provide fluid communication from a central bore of the mandrel to a setting chamber formed between the outer sleeve and the mandrel;

a piston configured to move axially along the mandrel in response to a setting pressure in the setting chamber, the piston configured to drive at least one radially actuatable component to actuate in a radial direction to engage a wellbore wall; and a pressure isolation assembly disposed in the setting chamber, the pressure isolation assembly configured to move axially with respect to the mandrel from a first position to a second position to seal the setting port, wherein the pressure isolation assembly is configured to seal the pressure release port in the first position and open the pressure release port in the second position.

7. A hydraulic set packer system, comprising:

an outer sleeve;

a mandrel extending through the outer sleeve;

a setting port extending through a radial wall of the mandrel, the setting port configured to provide fluid communication from a central bore of the mandrel to a setting chamber formed between the outer sleeve and the mandrel;

a piston configured to move axially along the mandrel in response to a setting pressure in the setting chamber, the piston configured to drive at least one radially actuatable component to actuate in a radial direction to engage a wellbore wall;

a pressure isolation assembly disposed in the setting chamber, the pressure isolation assembly configured to move axially with respect to the mandrel from a first position to a second position to seal the setting port; and a pressure isolation assembly stop secured to the mandrel, wherein pressure isolation assembly stop is configured contact the pressure isolation assembly to block axial movement of the pressure isolation assembly at the second position.

8. The system of claim 1, wherein the piston is a least partially disposed within the setting chamber to seal a first side of the setting chamber from the wellbore.

9. The system of claim 1, wherein the pressure isolation assembly comprises a pressure isolation ring having an axial through-bore.

10. The system of claim 1, wherein the pressure isolation assembly comprises an isolation piston, wherein isolation piston configured to move axially into a piston seal assembly aligned with the setting port to seal the setting port.

11. The system of claim 1, wherein the shear member comprises a shear pin.

12. The system of claim 2, further comprising a biasing mechanism configured to drive the pressure isolation assembly from the first position in a direction toward the second position, and wherein the biasing mechanism comprises a compression spring disposed between the pressure isolation assembly and a spring block, and wherein the compression spring is compressed in the first position.

13. The system of claim 2, wherein the outer sleeve comprises a pressure release port extending through a radial wall of the outer sleeve, wherein the pressure release port is configured to provide fluid communication between the setting chamber and a wellbore.

14. The system of claim 2, wherein the piston is a least partially disposed within the setting chamber to seal a first side of the setting chamber from the wellbore.

15. The system of claim 6, further comprising a biasing mechanism configured to drive the pressure isolation assembly from the first position in a direction toward the second position, and wherein the biasing mechanism comprises a compression spring disposed between the pressure isolation assembly and a spring block, and wherein the compression spring is compressed in the first position.

16. The system of claim 6, wherein the outer sleeve comprises a pressure release port extending through a radial wall of the outer sleeve, wherein the pressure release port is configured to provide fluid communication between the setting chamber and a wellbore.

17. The system of claim 6, wherein the piston is a least partially disposed within the setting chamber to seal a first side of the setting chamber from the wellbore.

18. The system of claim 7, further comprising a biasing mechanism configured to drive the pressure isolation assembly from the first position in a direction toward the second position, and wherein the biasing mechanism comprises a compression spring disposed between the pressure isolation assembly and a spring block, and wherein the compression spring is compressed in the first position.

19. The system of claim 7, wherein the outer sleeve comprises a pressure release port extending through a radial wall of the outer sleeve, wherein the pressure release port is configured to provide fluid communication between the setting chamber and a wellbore.

20. The system of claim 7, wherein the piston is a least partially disposed within the setting chamber to seal a first side of the setting chamber from the wellbore.

* * * * *